United States Patent [19]

Chang et al.

[11] Patent Number: 4,789,491

[45] Date of Patent: Dec. 6, 1988

[54] METHOD FOR PREPARING BIODEGRADABLE FABRIC SOFTENING COMPOSITIONS

[75] Inventors: Nienyuan J. Chang; Darlene R. Walley, both of Cincinnati, Ohio

[73] Assignee: The Procter & Gamble Company, Cincinnati, Ohio

[21] Appl. No.: 83,602

[22] Filed: Aug. 7, 1987

[51] Int. Cl.[4] ..... D06M 13/46

[52] U.S. Cl. ..... 252/8.75; 252/8.6

[58] Field of Search ..... 252/8.8, 8.75

[56] References Cited

U.S. PATENT DOCUMENTS

| | | | |
|---|---|---|---|
| 3,681,241 | 8/1972 | Rudy | 252/8.75 |
| 3,793,196 | 2/1974 | Okazaki et al. | 252/8.6 |
| 4,076,632 | 2/1978 | Davis | 252/8.8 |
| 4,155,855 | 5/1979 | Goffinet et al. | 252/8.8 |
| 4,157,307 | 6/1979 | Jaeger et al. | 252/8.75 |
| 4,339,391 | 7/1982 | Hoffman et al. | 260/401 |
| 4,401,578 | 8/1983 | Verbruggen | 252/8.8 |
| 4,422,949 | 12/1983 | Ooms | 252/8.8 |
| 4,426,299 | 1/1984 | Verbruggen | 252/8.8 |
| 4,439,330 | 3/1984 | Ooms | 252/8.8 |
| 4,454,049 | 6/1984 | MacGilp et al. | 252/8.8 |
| 4,476,031 | 10/1984 | Ooms | 252/8.8 |

FOREIGN PATENT DOCUMENTS

| | | |
|---|---|---|
| 0000406 | 1/1979 | European Pat. Off. . |
| 0018039 | 10/1980 | European Pat. Off. . |
| 1619043 | 4/1967 | Fed. Rep. of Germany . |
| 2430140 | 2/1976 | Fed. Rep. of Germany . |
| 2829022 | 1/1980 | Fed. Rep. of Germany . |
| 2007734A | 5/1978 | United Kingdom . |
| 1601360 | 10/1981 | United Kingdom . |

*Primary Examiner*—A. Lionel Clingman

*Attorney, Agent, or Firm*—Bart S. Hersko; George W. Allen; Steven J. Goldstein

[57] ABSTRACT

Disclosed is a method for preparing fabric softening compositions containing quarternized di-esters or di-isopropanol amines. When formulated using the disclosed procedure, including the use of narrowly-defined pH and temperature ranges, the resulting compositions are both biodegradable and storage stable.

26 Claims, No Drawings

METHOD FOR PREPARING BIODEGRADABLE FABRIC SOFTENING COMPOSITIONS

TECHNICAL FIELD

The present invention relates to a method for preparing textile treatment compositions. In particular, it relates to preparation of textile treatment compositions for use in the rinse cycle of a textile laundering operation to provide fabric softening/static control benefits, the compositions being characterized by excellent storage stability and viscosity characteristics and biodegradability. The compositions herein can also be used to treat fabrics in hot air clothes dryers, and in hair conditioner compositions.

BACKGROUND OF THE INVENTION

Textile treatment compositions suitable for providing fabric softening and static control benefits during laundering are well-known in the art and have found wide-scale commercial application. Conventionally, rinse-added fabric softening compositions contain, as the active softening component, substantially water-insoluble cationic materials having two long alkyl chains. Typical of such materials are di-stearyl di-methyl ammonium chloride and imidazolinium compounds substituted with two stearyl groups. These materials are normally prepared in the form of a dispersion in water and it is generally not possible to prepare such aqueous dispersions with more than about 10% of cationic materials without encountering intractable problems of product viscosity and stability, especially after storage at elevated temperatures, such that the compositions are unpourable and have inadequate dispensing and dissolving characteristics in rinse water. This physical restriction on softener concentration naturally limits the level of softening performance achievable without using excessive amounts of product, and also adds substantially to the costs of distribution and packaging. Accordingly it would be highly desirable to have a method for preparing physically-acceptable textile treatment compositions containing much higher levels of water-insoluble cationic softener materials.

It would also be desirable to have a method for preparing fabric softeners which are storage-stable, and also which are biodegradable. However, materials which may be biodegradable are often difficult to formulate as stable liquid compositions.

It is an object of this invention to provide a novel method for manufacturing biodegradable fabric softener compositions. It is a further object to provide a method for manufacturing liquid fabric softening compositions, including concentrates, containing quaternized di-esters of di-isopropanol amines which exhibit improved stability and viscosity characteristics, even after prolonged storage. These and other objects are obtained by following the procedure described herein.

Cationic softener materials are normally supplied by the manufacturer in the form of a slurry containing about 70%–95% of active material in an organic liquid such as isopropanol, sometimes containing a minor amount of water (up to about 10%). Retail fabric softening compositions are then prepared by dispersion of the softener slurry in warm water under carefully controlled conditions. The physical form and dispersibility constraints of these industrial concentrates, however, are such as to preclude their direct use by the domestic consumer; indeed, they can pose severe processing problems even for the industrial supplier of retail fabric softening compositions.

The use of various quaternized ester amines as fabric softening agents is known in the art. See, for example, U.S. Pat. No. 4,339,391, Hoffmann, et al, issued July 13, 1982, for a series of quaternized ester-amines which function as fabric softeners. Various quaternized ester-amines are commercially available under the tradenames SYNPROLAM FS from ICI and REWOQUAT CR 3099 from REWO. However, neither the specific quaternized di-esters of di-isopropanol amines of the present invention, nor the desirable fabric softener/viscosity/stability/biodegradability properties of the fabric softening compositions manufactured in the manner disclosed herein appear to have been appreciated heretofore.

U.S. Pat. Nos. 4,426,299, issued Jan. 17, 1984, and 4,401,578, issued Aug. 30, 1983, Verbruggen, relate to paraffin, fatty acids and ester extenders for softener concentrates.

European Pat. No. 0,018,039, Clint, et al, issued Mar. 7, 1984, relates to hydrocarbons plus soluble cationic or nonionic surfactants in softener concentrates to improve viscosity and stability characteristics.

U.S. Pat. No. 4,454,049, MacGilp, et al, issued June 12, 1984, discloses concentrated liquid textile treatment compositions in the form of isotropic solutions comprising water-insoluble di-$C_{16}$–$C_{24}$ optionally hydroxy-substituted alkyl, alkaryl or alkenyl cationic fabric softeners, at least about 70% of the fabric softener consisting of one or more components together having a melting completion temperature of less than about 20° C., a water-insoluble nonionic extender, especially $C_{10}$–$C_{40}$ hydrocarbons or esters of mono- or polyhydric alcohols with $C_8$–$C_{24}$ fatty acids, and a water-miscible organic solvent. The concentrates have improved formulation stability and dispersibility, combined with excellent fabric softening characteristics.

U.S. Pat. No. 4,439,330, Ooms, issued Mar. 27, 1984, teaches concentrated softeners comprising ethoxylated amines.

U.S. Pat. No. 4,476,031, Ooms, issued Oct. 9, 1984, teaches ethoxylated amines or protonated derivatives thereof, in combination with ammonium, imadazolinium, and like materials. The use of alkoxylated amines, as a class, in softener compositions is known (see, for example, German Patent Applications Nos. 2,829,022, Jakobi and Schmadel, published Jan. 10, 1980, and 1,619,043, Mueller et al., published Oct. 30, 1969, and U.S. Pat. Nos. 4,076,632, Davis, issued Feb. 28, 1978, and 4,157,307, Jaeger and Davis, issued June 5, 1979).

U.S. Pat. No. 4,422,949, Ooms, issued Dec. 27, 1983, relates to softener concentrates based on ditallow dimethyl ammonium chloride (DTDMAC), glycerol monostearate and polycationics.

In United Kingdom Application No. 2,007,734A, Sherman et al., published May 23, 1979, fabric softener concentrates are disclosed which contain a mixture of a fatty quaternary ammonium salt having at least one $C_8$–$C_{30}$ alkyl substituent and an oil or substantially water-insoluble compound having oily/fatty properties. The concentrates are said to be easily dispersed/emulsified in cold water to form fabric softening compositions.

Concentrated dispersions of softener material can be prepared as described in European Patent Application No 406 and United Kingdom Patent Specification No.

1,601,360, Goffinet, published Oct. 28, 1981, by incorporating certain nonionic adjunct softening materials therein.

As can be seen, the specific problem of preparing fabric softening compositions in concentrated form suitable for consumer use has been addressed in the art, but the various solutions have not been entirely satisfactory. It is generally known (for example, in U.S. Pat. No. 3,681,241, Rudy, issued Aug. 1, 1972,) that the presence of ionizable salts in softener compositions does help reduce viscosity, but this approach is ineffective in compositions containing more than about 12% of dispersed softener, inasmuch as the level of ionizable salts necessary to reduce viscosity to any substantial degree has a seriously detrimental effect on product stability.

SUMMARY OF THE INVENTION

The present invention encompasses a novel method for manufacturing aqueous biodegradable shelf-stable fabric softening compositions. The first step in this process is combining a $C_1$–$C_4$ monohydric alcohol (e.g., isopropanol) with a biodegradable quaternary ammonium softening compound of the formula:

$$[R]_2-{}^{\oplus}N-[CH_2\underset{\underset{R''}{|}}{CH}-O-C(O)R']_2X^{\ominus}$$

wherein each R substituent is a short-chain ($C_1$–$C_6$, preferably $C_1$–$C_3$) alkyl or hydroxyalkyl group, e.g., methyl (most preferred), ethyl, propyl, hydroxyethyl, and the like, or mixtures thereof; each R′ is a long-chain hydrocarbyl substituent, e.g., $C_{13}$–$C_{17}$, preferably $C_{15}$ alkyl, or mixtures thereof; and R″ is a short-chain ($C_1$–$C_4$) hydrocarbyl substituent, preferably methyl. The counterion $X^-$ is not critical herein, and can be any softener compatible anion, for example, chloride, bromide, methylsulfate, formate, sulfate, nitrate and the like. It will be understood that substituents R, R′ and R″ may optionally be substituted with various groups such as alkoxyl, hydroxyl, or can be branched, but such materials are not preferred herein. The preferred compounds can be considered to be quaternized di-esters of di-isopropanol amines. The amount of the $C_1$–$C_4$ monohydric alcohol is from about 5% to about 50% by weight of the biodegradable quaternary ammonium softening compound present in the mixture.

Said mixture is heated to a temperature of from about 60° C. to about 90° C. to form a fluidized melt. The fluidized melt is diluted with water, heated to a temperature of from about 50° C. to about 85° C., to form a dilute mixture with a concentration of from about 1% to about 25% by weight of the biodegradable quaternary ammonium softening compound. Said dilute mixture is mixed with a high shear mixer to form a homogeneous mixture with the softening compound having a particle size of from about 0.1 to about 0.5 microns. The pH is adjusted to from about 2.0 to about 5.0 by adding a sufficient amount of a Bronsted acid to the homogenous mixture. The above process steps do not necessarily have to be carried out sequentially. For example, the diluting step and the high shear mixing step can be carried out either concurrently or sequentially. Similarly one could adjust the pH by Bronsted acid addition at a point in the process other than the end, if desired. Thus, the present invention should not be construed as requiring the processing steps to be carried out in the order listed above.

In brief, the present invention encompasses a novel method for manufacturing liquid fabric softening and antistatic compositions, said compositions comprising: a liquid carrier, which is a mixture of water and a $C_1$–$C_4$ monohydric alcohol, and at least about 1% by weight of a fabric softener compound of the above-disclosed formula dispersed in said carrier. Such liquid compositions are formulated at a pH of from about 2.0 to about 5.0, preferably $3.5\pm0.5$, to provide good storage stability. The temperature during processing also influences the hydrolytic stability of these compositions and should be kept within the specified ranges. For general laundry fabric softening use in a rinse-added mode, such compositions will typically comprise from about 1% to about 9%, preferably from about 3% to about 8%, by weight of the softener compound.

The liquid compositions prepared according to the method disclosed herein have the softener compound present as particles dispersed in the carrier. The particles are preferably sub-micron size, generally having average diameters in the range of about 0.10–0.50, preferably 0.20–0.40, microns. Such particle dispersions can optionally be stabilized with emulsifiers.

Importantly, the liquid compositions prepared herein are substantially free (generally, less than 1%) of free (i.e., unprotonated) amines, since free amines can catalyze decomposition of the softener compounds on storage. In fact, even if only minor amounts of amines are present, they should be protonated with acid during formulation of the compositions. Strong acids, such as $H_3PO_4$ and HCl, can be used for this purpose.

The low viscosities exhibited by dispersions of particles of the softener compounds herein allows them to be formulated as water-dilutable fabric softener "high concentrates" which contain from about 10% to about 25% by weight of the fabric softener compound. Such high concentrates may be conveniently packaged in pouches, which can be diluted with water to "single-strength" softeners (typically, 3–5% concentration of softener active) by the user.

While not intending to be limited by theory, it is believed that the ester moieties lend biodegradability to these softener compounds, whereas the chain branching of the isopropyl moiety provides sufficient hydrolytic stability that the compounds can be stably formulated as liquid compositions, under the conditions disclosed hereinafter. The desirable viscosity characteristics of the compositions prepared herein, which allows them to be formulated as concentrates, are entirely unexpected. Moreover, since the fabric softener compounds used in these compositions are cationic, these compositions provide not only fiber and fabric softness, but also antistatic benefits.

All percentages, ratios and proportions herein are by weight, unless otherwise specified.

DETAILED DESCRIPTION OF THE INVENTION

The active softener ingredient used herein is a biodegradable quaternary ammonium softening compound of the formula:

$$[R]_2-{}^{\oplus}N-[CH_2\underset{\underset{R''}{|}}{CH}-O-C(O)R']_2X^{\ominus}$$

wherein each R substituent is a short chain ($C_1$–$C_6$, preferably $C_1$–$C_3$) alkyl or hydroxyalkyl group, e.g., methyl (most preferred), ethyl, propyl, hydroxyethyl, and the like, or mixtures thereof; R' is a long-chain hydrocarbyl substituent, e.g., $C_{13}$–$C_{17}$, preferably $C_{15}$ alkyl, or mixtures thereof; and R'' is a short-chain ($C_1$–$C_4$) hydrocarbyl substituent, preferably methyl. The counterion $X^-$ is not critical herein, and can be any softener-compatible anion, for example, chloride, bromide, methylsulfate, formate, sulfate, nitrate, and the like. It will be understood that substituents R, R' and R'' may optionally be substituted with various groups such as alkoxyl, hydroxyl, or can be branched, but such materials are not preferred herein. The preferred biodegradable softening compounds for use herein are quaternized di-esters of di-isopropanol amines.

The above compounds used as the active softener ingredients may be prepared using standard reaction chemistry. In a typical synthesis, an amine of the formula $RN(CH_2CHR''OH)_2$ is esterified at both hydroxyl groups with an acid chloride of the formula R'C(O)Cl, then quaternized with an alkyl halide, RX, to yield the desired reaction product (wherein R, R', and R'' are as defined above). A method for the synthesis of a preferred softener compound is disclosed in detail hereinafter. However, it will be appreciated by those skilled in the chemical arts that this reaction sequence allows a broad selection of compounds to be prepared. As illustrative, nonlimiting examples there can be mentioned the following (wherein all long-chain alkyl substituents are straight-chain):

$$[HO{-}CH(CH_3)CH_2][CH_3]^{\oplus}N[CH_2CH(CH_3)OC(O)C_{15}H_{31}]_2Br^{\ominus}$$

$$[C_2H_5]_2^{\oplus}N[CH_2CH(CH_3)OC(O)C_{17}H_{35}]_2Cl^{\ominus}$$

$$[CH_3][C_2H_5]^{\oplus}N[CH_2CH(C_2H_5)OC(O)C_{13}H_{27}]_2I^{\ominus}$$

$$[C_3H_7][C_2H_5]^{\oplus}N[CH_2CH(C_3H_7)OC(O)C_{15}H_{31}]_2SO_4CH_3$$

$$[CH_3]_2^{\oplus}N{-}CH_2CH(CH_3)OC(O)C_{15}H_{31}Cl^{\ominus}$$
$$\quad\quad |$$
$$\quad\quad CH_2CH(CH_3)OC(O)C_{17}H_{35}$$

Since the foregoing compounds are somewhat labile to hydrolysis, they should be handled rather carefully when used to formulate the compositions herein. For example, stable liquid compositions herein are formulated at a pH in the range of about 2.0 to about 5.0, preferably about pH 3.5±0.5. The pH is adjusted by the addition of a Bronsted acid.

Examples of suitable acids include the inorganic mineral acids, carboxylic acids, in particular the low molecular weight ($C_1$–$C_5$) carboxylic acids, and alkylsulfonic acids. Suitable inorganic acids include HCl, $H_2SO_4$, $HNO_3$ and $H_3PO_4$. Suitable organic acids include formic, acetic, methylsulfonic and ethylsulfonic acid. Preferred acids are hydrochloric and phosphoric acids.

Many fully-formulated fabric softener compositions comprise mixtures of various softener compounds; therefore, the compositions prepared herein can optionally contain additional softening agents.

The liquid compositions prepared by the method disclosed herein comprise a liquid carrier, which is a mixture of water and a $C_1$–$C_4$ monohydric alcohol (e.g., ethanol, propanol, isopropanol, butanol, and mixtures thereof), isopropanol being preferred. The softener compounds used in this invention are insoluble in such water-based carriers and, thus, are present as a dispersion of fine particles therein. These particles are submicron in size and are conveniently prepared by high-shear mixing which disperses the compounds as fine particles. The method of preparation of a preferred dispersion is disclosed in detail hereinafter. Again, since the compounds are hydrolytically labile, care should be taken to avoid the presence of base and to keep the processing temperatures, and pH within the ranges specified hereinafter.

The particulate dispersions of the foregoing type can optionally be stabilized against settling by means of standard non-base emulsifiers, especially nonionic extenders. Such nonionics and their usage levels, have been disclosed in U.S. Pat. No. 4,454,049, MacGilp, et al., issued June 12, 1984, the disclosure of which is incorporated herein by reference.

Specific examples of nonionic extenders suitable for the compositions herein include glycerol esters (preferably glycerol monostearate), fatty alcohols (e.g., stearyl alcohol), and ethoxylated alcohols (preferably Neodol 23-3—the condensation product of $C_{12}$–$C_{13}$ linear alcohol with 3 moles ethylene oxide). Mixtures of glycerol monostearate and Neodol 23-3 are particularly preferred. The nonionic, if used, is typically used at a levels in the range of from about 0.1 to about 10% by weight of the composition.

METHOD OF PREPARATION

The method for preparation of a liquid fabric softener composition for use in the rinse cycle of a standard laundering operation is as follows. Compositions prepared according to this preparation method have improved hydrolytic stability, colloidal stability, and excellent viscosity characteristics, even over prolonged periods of storage.

The method of preparing the biodegradable softening compositions consists generally of preparing a premix of the water-insoluble biodegradable quaternary ammonium softening compound and a $C_1$–$C_4$ monohydric alcohol, heating the premix, intimately mixing the premix with hot water to form an aqueous dispersion, and adjusting the pH of the final mixture with a Bronsted acid.

A. Preparation of dilute softener composition

| Ingredient | Amount (wt. %) |
|---|---|
| Biodegradable Quaternary Ammonium Softening Compound (as defined herein) | 1–9% |
| $C_1$–$C_4$ Monohydric Alcohol | 0.1–3% |
| Protonated Free Amine | 0–1% |
| Conventional di-(higher alkyl) Quaternary Ammonium Compound | 0–5% |
| Nonionic Extender | 0–3% |
| Thickening Agent | 0–2% |
| Silicone Component | 0–10% |
| Preservative | 0–0.02% |
| Salt | 0–0.3% |
| Bronsted Acid | 0.01–0.5% |
| Dyes, and other miscellaneous minors | 0–1.0% |
| Water | Balance |

The nonhydrolytic preparation of this composition is carried out as follows. The biodegradable quaternary ammonium softening compound (as defined herein) and $C_1$–$C_4$ monohydric alcohol (preferably isopropanol) are mixed (optionally, a protonated free amine or an nonionic extender, and a conventional di- (higher alkyl) quarternary ammonium compound can be added to the mixture at this time) and heated to from about 60° C. to about 90° C. (preferably from about 70° C. to about 80° C.) to form a fluidized "melt". The ratio of the $C_1$–$C_4$ monohydric alcohol to the softener compound in the melt is from about 5% to about 50% alcohol/softener compound. The melt is poured into water heated to a temperature of from about 50° C. to about 85° C. (preferably from about 60° C. to about 80° C.). Said dilute mixture is mixed with a high shear mixer from about 700 to about 10,000 rpm (preferably about 7000 rpm) for about 10–30 minutes (preferably about 20 minutes) to form a homogeneous mixture with an average particle size of from about 0.1 to about 0.5 microns. During mixing, about 0–0.3% of a salt (preferably $CaCl_2$) can be added to prevent gelling, if necessary. The dye and minors (e.g. perfumes) can be added before or after the high-shear mixing. The pH is adjusted with the Bronsted acid (preferably $H_3PO_4$ or HCl) to from about 2.0 to about 5.0 (preferably from about 3.0 to about 4.0). The resulting dispersion has a viscosity of from about 15 to 200, preferably from about 40 to about 120 centipoise (at 25° C.) and is used in standard fashion as a rinse-added fabric softener. If desired, the viscosity can be adjusted through the use of a thickening agent. The thickening agent is added to the dispersion upon cooling. A silicone component may also be added at this time to the mixture, if desired to provide fabric feel benefits and to improve the water absorbency of fabrics treated with the softening composition prepared herein. All of the dilute dispersions herein are prepared in substantially the same manner.

B. Preparation of concentrated softener composition

| Ingredient | Amount (wt. %) |
|---|---|
| Biodegradable Quaternary Ammonium Softening Compound (as defined herein) | 10–25% |
| $C_1$–$C_4$ Monohydric Alcohol | 0.5–8% |
| Protonated Free Amine | 0–3% |
| Conventional di-(higher alkyl) Quaternary Ammonium | 0–15% |
| Nonionic Extender | 0–5% |
| Thickening Agent | 0–2% |
| Silicone Component | 1–10% |
| Preservative | 0–0.02% |
| Salt | 0–0.3% |
| Bronsted Acid | 0.01–0.5% |
| Dyes, and other miscellaneous minors | 0–1.0% |
| Water | Balance |

The nonhydrolytic preparation of this composition is carried out as follows. The fluidized "melt" is prepared in the same manner as described above in preparing dilute dispersions. The melt is poured into water heated to a temperature of from about 50° C. to about 85° C. (preferably from about 50° C. to about 65° C.). Said concentrated mixture is mixed with a high shear mixer (e.g., about 7000 rpm; about 10–30 minutes) to form a homogeneous mixture with an average particle size of from about 0.1 to about 0.5 microns. During mixing, about 0 to 0.3% salt (preferably $CaCl_2$) is added to prevent gelling. The dye and other minors are added to the water before mixing. After cooling, a silicone component may be added to the dispersion, if desired, to provide fabric feel benefits and to improve the water absorbency of fabrics treated with the softening composition prepared herein. The pH is adjusted with the Bronsted acid (preferably $H_3PO_4$ or HCl) to from about 2.0 to about 5.0 (preferably from about 3.0 to about 4.0). The resulting dispersion has a viscosity of from about 50 to about 10,000 centipoise (at 25° C.). All of the concentrated dispersions are prepared in substantially the same manner.

In a convenient mode, these concentrated compositions are packaged in a simple plastic pouch, which is opened and poured into 4× its volume of water prior to use to prepare a "single strength" softener composition, thereby saving on packaging and shipping costs and storage space.

BIODEGRADABLE QUATERNARY AMMONIUM SOFTENING COMPOUND

The preferred biodegradable quaternary ammonium fabric softening compound used in the present invention may be synthesized using the following two-step process:

Step A. Synthesis of Amine

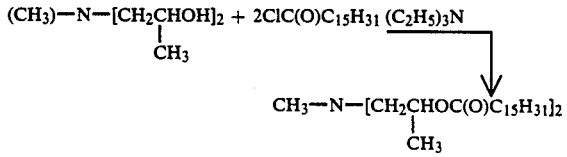

PROCEDURE 0.6 mole of diisopropyl methyl amine is placed in a 3-liter, 3-necked flask equipped with a reflux condenser, argon (or nitrogen) inlet and two addition funnels. In one addition funnel is placed 0.8 moles of triethylamine and in the second addition funnel is placed 1.2 moles of palmitoyl chloride in a 1:1 solution with methylene chloride. Methylene chloride (750 mL) is added to the reaction flask containing the amine and heated to 35° C. (water bath). The triethylamine is added dropwise, and the temperature is raised to 40°–45° C. while stirring over one-half hour. The palmitoyl chloride/methylene chloride solution is added dropwise and allowed to heat at 40°–45° C. under inert atmosphere overnight (12–16 h).

The reaction mixture is cooled to room temperature and diluted with chloroform (1500 mL). The chloroform solution of product is placed in a separatory funnel (4 L) and washed with sat. NaCl, dil. $Ca(OH)_2$, 50% $K_2CO_3$ (3 times)*, and, finally, sat. NaCl. The organic layer is collected and dried over $MgSO_4$ and filtered. Solvents are removed via rotary evaporation. Final drying is done under high vacuum (0.25 mm Hg).

*Note: 50% $K_2CO_3$ layer will be below chloroform layer.

ANALYSIS

TLC (thin layer chromatography)**: solvent system (75% diethyl ether: 25% hexane) Rf=0.8.

**10×20 cm pre-scored glass plates, 250 micron silica gel; visualization by PMA (phosphomolybdic acid—5% in ethanol) staining.

IR ($CCl_4$): 2900, 2850, 2810, 1722, 1450, 1358 $cm^{-1}$.

$^1$H-NMR ($CDCl_3$): 4.7–5.1 (2H), 2.1–2.5 (8H), 2.3 (3H), 1.25 (52H), 1.1 (6H), 0.8 (6H) ppm (relative to tetramethylsilane=0 ppm).

Step B: Quaternization

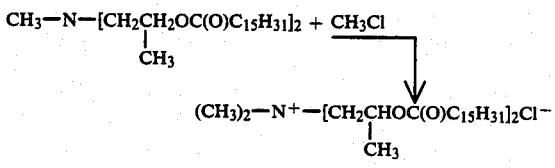

PROCEDURE 0.5 moles of the diisopropyl palmitate methyl amine from Step A is placed in an autoclave sleeve along with 200–300 mL of acetonitrile (anhydrous). The sample is then inserted into the autoclave and purged three times with He (16275 mm Hg/21.4 ATM.) and once with $CH_3Cl$. The reaction is heated to 80° C. under a pressure of 3604 mm Hg/4.7 ATM. $CH_3Cl$ for 24 hours. The autoclave sleeve is then removed from the reaction mixture. The sample is dissolved in chloroform and solvent is removed by rotary evaporation, followed by drying on high vacuum (0.25 mm Hg).

ANALYSIS

TLC (5:1 chloroform:methanol)*: Rf=0.3.

*10×20 cm pre-scored glass plates, 250 microns silica gel; visualization by PMA staining.

IR ($CCl_4$): 2900, 2832, 1725, 1450, 1370 $cm^{-1}$.

$^1$H-NMR ($CDCl_3$): 5.0–5.5 (2H), 3.4–3.7 (4H), 2.0–2.7. (10H), 1.2–1.5 (52H), 1.2 (6H), 0.9 (6H) ppm (relative to tetramethylsilane=0 ppm).

$^{13}$C-NMR ($CDCl_3$): 173.2, 68.2, 67.8, 64.9, 43.5, 34.6, 31.8, 29.5, 24.9, 24.6, 22.6, 18.9, 18.2, 14.0 ppm (relative to tetramethylsilane=0 ppm).

OPTIONAL INGREDIENTS

Fully-formulated fabric softening compositions may contain, in addition to the rapidly biodegradable quaternary ammonium compound of the formula herein and liquid carrier, one or more of the following optional ingredients.

CONVENTIONAL QUATERNARY AMMONIUM SOFTENING AGENTS

As mentioned before, the compositions formulated using the present invention can further comprise a conventional di(higher alkyl) quaternary ammonium softening agent. The compositions herein can contain from 0% to about 25% (preferably from about 0.1% to about 10%) of the conventional di(higher alkyl)quaternary ammonium softening agent.

By "higher alkyl", as used in the context of the quaternary ammonium salts herein, is meant alkyl groups having from about 8 to about 30 carbon atoms, preferably from about 11 to about 22 carbon atoms. Examples of such conventional quaternary ammonium salts include:

(i) acyclic quaternary ammonium salts having the formula:

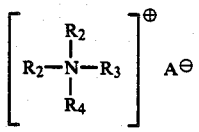

wherein $R_2$ is an acyclic aliphatic $C_{15}$–$C_{22}$ hydrocarbon group, $R_3$ is a $C_1$–$C_4$ saturated alkyl or hydroxyalkyl group, $R_4$ is selected from $R_2$ and $R_3$, and A is an anion;

(ii) diamido quaternary ammonium salts having the formula:

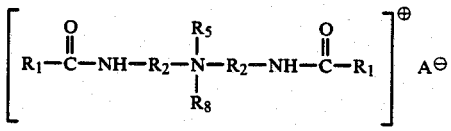

wherein $R_1$ is an acyclic aliphatic $C_{15}$–$C_{22}$ hydrocarbon group, $R_2$ is a divalent alkylene group having 1 to 3 carbon atoms, $R_5$ and $R_8$ are $C_1$–$C_4$ saturated alkyl or hydroxyalkyl groups, and $A^-$ is an anion;

(iii) diamido alkoxylated quaternary ammonium salts having the formula:

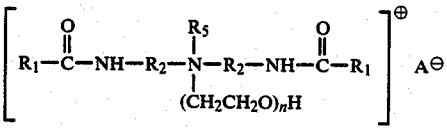

wherein n is equal to from about 1 to about 5, and $R_1$, $R_2$, $R_5$ and $A^-$ are as defined above;

(iv) quaternary imidazolinium compounds having the formula:

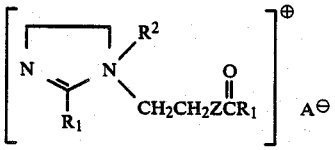

wherein $R_1$=$C_{15}$–$C_{17}$ saturated alkyl, $R_2$=$C_1$–$C_4$ saturated alkyl or H, Z=NH or O, and $A^-$ is an anion.

Examples of Component (i) are the well-known dialkyldimethylammonium salts such as ditallowdimethylammonium chloride, ditallowdimethylammonium methylsulfate, di(hydrogenated tallow)dimethylammonium chloride, dibehenyldimethylammonium chloride.

Examples of Component (ii) and (iii) are methylbis(tallowamidoethyl)(2-hydroxyethyl)ammonium methylsulfate and methylbis(hydrogenated tallowamidoethyl)(2-hydroxyethyl)ammonium methylsulfate, wherein $R_1$ is an acyclic aliphatic $C_{15}$–$C_{17}$ hydrocarbon group, $R_2$ is an ethylene group, $R_5$ is a methyl group, $R_8$ is a hydroxyalkyl group and A is a methylsulfate anion; these materials are available from Sherex Chemical Company under the trade names Varisoft® 222 and Varisoft® 110, respectively.

Examples of component (iv) are 1-methyl-1-tallowamino-ethyl-2-tallowimidazolinium methylsulfate and 1-methyl-1-(hydrogenated tallowamidoethyl)-methylsulfate.

FREE AMINES

The liquid compositions produced by the method herein should be substantially free (generally less than about 1%) of free (i.e. unprotonated) amines. Care should be taken that if minor amounts of these amines are used to enhance the dispersion stability of the compositions, that they are protonated with acid during formulation, otherwise the free amines may catalyze decomposition of the biodegradable quaternary ammonium compounds during storage. Minor amounts of protonated amines, typically from about 0.05% to about 1.0%, namely primary, secondary and tertiary amines having, at least, one straight-chain organic group of from about 12 to about 22 carbon atoms may be used herein to enhance dispersion stability. Preferred amines of this class are ethoxyamines, such as monotallow-dipolyethoxyamine, having a total of from about 2 to about 30 ethoxy groups per molecule. Also suitable are diamines such as tallow-N,N', N'-tris(2-hydroxyethyl)-1,3-propylenediamine, or $C_{16}$–$C_{18}$-alkyl-N-bis(2-hydroxyethyl)amines.

Examples of the above compounds are those marketed under the trade name GENAMIN C, S, O and T, by Hoechst.

DI-(HIGHER ALKYL) CYCLIC AMINE

The compositions prepared herein optionally comprise from 0% to about 25% (preferably from about 0.1% to about 10%) by weight of the composition of a di(higher alkyl) cyclic amine fabric softening agent of the formula:

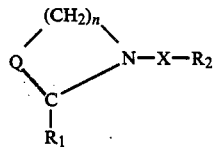

wherein n is 2 or 3, preferably 2; $R_1$ and $R_2$ are, independently, a $C_8$–$C_{30}$ alkyl or alkenyl, preferably $C_{11}$–$C_{22}$ alkyl, more preferably $C_{15}$–$C_{18}$ alkyl, or mixtures of such alkyl radicals. Examples of such mixtures are the alkyl radicals obtained from coconut oil, "soft" (non-hardened) tallow, and hardened tallow. Q is CH or N, preferably N. X is

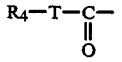

wherein T is O or $NR_5$, $R_5$ being H or $C_1$–$C_4$ alkyl, preferably H, and $R_4$ is a divalent $C_1$–$C_3$ alkylene group or $(C_2H_4O)_m$, wherein m is from about 1 to about 8.

SILICONE COMPONENT

The fabric softening composition prepared herein optionally contains an aqueous emulsion of a predominantly linear polydialkyl or alkyl aryl siloxane in which the alkyl groups can have from one to five carbon atoms and may be wholly or partially fluorinated. These siloxanes act to provide improved fabric feel benefits. Suitable silicones are polydimethyl siloxanes having a viscosity, at 25° C., of from about 100 to about 100,000 centistokes, preferably from about 1000 to about 12,000 centistokes.

It has been found that the ionic charge characteristics of the silicone as used in the present invention are important in determining both the extent of deposition and the evenness of distribution of the silicone and hence the properties of a fabric treated therewith.

Silicones having cationic character show an enhanced tendency to deposit. Silicones found to be of value in providing fabric feel benefits having a predominantly linear character and are preferably polydialkyl siloxanes in which the alkyl group is most commonly methyl. Such silicone polymers are frequently manufactured commercially by emulsion polymerization using a strong acid or strong alkali catalyst in the presence of a nonionic or mixed nonionic anionic emulsifier system. In addition to providing improved fabric feel benefits, the silicone components also improve the water absorbency of the fabrics treated with the softening compositions prepared herein.

The optional silicone component embraces a silicone of cationic character which is defined as being one of:

(a) a predominantly linear di-$C_1$–$C_5$ alkyl or $C_1$–$C_5$ alkyl aryl siloxane, prepared by emulsion polymerization using a cationic or nonionic surfactant as emulsifier;

(b) an alpha-omega-di-quaternized di-$C_1$–$C_5$ alkyl or $C_1$–$C_5$ alkyl aryl siloxane polymer; or (c) an amino-functional di-$C_1$–$C_5$ alkyl or alkyl aryl siloxane polymer in which the amino group may be substituted and may be quaternized and in which the degree of substitution (d.s.) lies in the range of from about 0.0001 to about 0.1, preferably from about 0.01 to about 0.075 provided that the viscosity at 25° C. of the silicone is from about 100 to about 100,000 cs.

The fabric softening compositions prepared herein may contain up to about 15%, preferably from about 0.1% to about 10%, of the silicone component.

THICKENING AGENT

Optionally, the compositions prepared herein contain from 0% to about 3%, preferably from about 0.01% to about 2%, of a thickening agent. Examples of suitable thickening agents include: cellulose derivatives, synthetic high molecular weight polymers (e.g., carboxyvinyl polymer and polyvinyl alcohol), and cationic guar gums.

The cellulosic derivatives that are functional as thickening agents herein agents may be characterized as certain hydroxyethers of cellulose, such as Methocel$^K$, marketed by Dow Chemicals, Inc.; also, certain cationic cellulose ether derivatives, such as Polymer JR-125 ®, JR-400 ®, and JR-30M ®, marketed by Union Carbide.

Other effective thickening agents are cationic guar gums, such as Jaguar Plus ®, marketed by Stein Hall, and Gendrive 458 ®, marketed by General Mills.

Preferred thickening agents herein are selected from the group consisting of methyl cellulose, hydroxypropyl methylcellulose, or hydroxybutyl methylcellulose, said cellulosic polymer having a viscosity in 2% aqueous solution at 20° C. of from about 15 to about 75,000 centipoise.

SOIL RELEASE AGENT

Optionally, the compositions prepared herein contain from 0% to about 10%, preferably from about 0.2% to about 5%, of a soil release agent. Preferably, such a soil release agent is a polymer. Polymeric soil release agents useful in the present invention include copolymeric blocks of terephathalate and polyethylene oxide or polypropylene oxide, and the like.

A preferred soil release agent is a copolymer having blocks of terephthalate and polyethylene oxide. More specifically, these polymers are comprised of repeating units of ethylene terephthalate and polyethylene oxide terephthalate at a molar ratio of ethylene terephthalate units to polyethylene oxide terephthalate units of from about 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon ®4780 (from Dupont) and Milease ® T (from ICI).

Highly preferred soil release agents are polymers of the generic formula:

$$X-(OCH_2CH_2)_n(O-\overset{O}{\overset{\|}{C}}-R^1-\overset{O}{\overset{\|}{C}}-OR^2)_u(O-\overset{O}{\overset{\|}{C}}-R^1-\overset{O}{\overset{\|}{C}}-O)(CH_2CH_2O)_n-X$$

in which X can be any suitable capping group, with each X being selected from the group consisting of H, and alkyl or acyl groups containing from about 1 to about 4 carbon atoms. n is selected for water solubility and generally is from about 6 to about 113, preferably from about 20 to about 50. u is critical to formulation in a liquid composition having a relatively high ionic strength. There should be very little material in which u is greater than 10. Furthermore, there should be at least 20%, preferably at least 40%, of material in which u ranges from about 3 to about 5.

The $R^1$ moieties are essentially 1,4-phenylene moieties. As used herein, the term "the $R^1$ moieties are essentially 1,4-phenylene moieties" refers to compounds where the $R^1$ moieties consist entirely of 1,4-phenylene moieties, or are partially substituted with other arylene or alkarylene moieties, alkylene moieties, alkenylene moieties, or mixtures thereof. Arylene and alkarylene moieties which can be partially substituted for 1,4-phenylene include 1,3-phenylene, 1,2-phenylene, 1,8-naphtylene, 1,4-naphtylene, 2,2-biphenylene, 4,4-biphenylene and mixtures thereof. Alkylene and alkenylene moieties which can be partially substituted include ethylene, 1,2-propylene, 1,4-butylene, 1,5-pentylene, 1,6-hexamethylene, 1,7-heptamethylene, 1,8-octamethylene, 1,4-cyclohexylene, and mixtures thereof.

For the $R^1$ moieties, the degree of partial substitution with moieties other than 1,4-phenylene should be such that the soil release properties of the compound are not adversely affected to any great extent. Generally, the degree of partial substitution which can be tolerated will depend upon the backbone length of the compound, i.e., longer backbones can have greater partial substitution for 1,4-phenylene moieties. Usually, compounds where the $R^1$ comprise from about 50% to about 100% 1,4-phenylene moieties (from 0 to about 50% moieties other than 1,4-phenylene) have adequate soil release activity. For example, polyesters made according to the present invention with a 40:60 mole ratio of isophthalic(1,3-phenylene) to terephthalic(1,4-phenylene) acid have adequate soil release activity. However, because most polyesters used in fiber making comprise ethylene terephthalate units, it is usually desirable to minimize the degree of partial substitution with moieties other than 1,4-phenylene for best soil release activity. Preferably, the $R^1$ moieties consist entirely of (i.e., comprise 100%) 1,4-phenylene moieties, i.e., each $R^1$ moiety is 1,4-phenylene.

For the $R^2$ moieties, suitable ethylene or substituted ethylene moieties include ethylene, 1,2-propylene, 1,2-butylene, 1,2-hexylene, 3-methoxy-1,2-propylene and mixtures thereof. Preferably, the $R^2$ moieties are essentially ethylene moieties, 1,2-propylene moieties or mixture thereof. Inclusion of a greater percentage of ethylene moieties tends to improve the soil release activity of compounds. Surprisingly, inclusion of a greater percentage of 1,2-propylene moieties tends to improve the water solubility of the compounds.

Therefore, the use of 1,2-propylene moieties or a similar branched equivalent is desirable for incorporation of any substantial part of the soil release component in the liquid fabric softener compositions. Preferably, from about 75% to about 100%, more preferably from about 90% to about 100%, of the $R^2$ moieties are 1,2-propylene moieties.

The value for each n is at least about 6, and preferably is at least about 10. The value for each n usually ranges from about 12 to about 113. Typically, the value for each n is in the range of from about 12 to about 43.

A more complete disclosure of these highly preferred soil release agents is contained in European Patent Application No. 185,427, Gosselink, published June 25, 1986, incorporated herein by reference.

VISCOSITY CONTROL AGENTS

Viscosity control agents can be organic or inorganic in nature. Examples of organic viscosity modifiers are fatty acids and esters, fatty alcohols, and water-miscible solvents such as short chain alcohols. Examples of inorganic viscosity control agents are water-soluble ionizable salts. A wide variety of ionizable salts can be used. Examples of suitable salts are the halides of the group IA and IIA metals of the Periodic Table of the Elements, e.g., calcium chloride, magnesium chloride, sodium chloride, potassium bromide, and lithium chloride. Calcium chloride is preferred. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from about 20 to about 3,000 parts per million (ppm), preferably from about 20 to about 2,000 ppm, by weight of the composition.

BACTERICIDES

Examples of bactericides used in the compositions of this invention include glutaraldehyde, formaldehyde, 2-bromo-2-nitropropane-1,3-diol sold by Inolex Chemicals under the trade name Bronopol ®, and a mixture of 5-chloro-2-methyl-4-isothiazolin-3-one and 2-methyl-4-isothiazoline-3-one sold by Rohm and Haas Company under the trade name Kathon ® CG/ICP. Typical levels of bacteriocides used in the present compositions are from about 1 to about 1,000 ppm by weight of the composition.

OTHER OPTIONAL INGREDIENTS

The present invention can include other optional components conventionally used in textile treatment compositions, for example, colorants, perfumes, preservatives, optical brighteners, opacifiers, fabric conditioning agents, surfactants, stabilizers such as guar gum and polyethylene glycol, anti-shrinkage agents, anti-wrinkle agents, fabric crisping agents, spotting agents, germicides, fungicides, anti-oxidants such as butylated hydroxy toluene, anti-corrosion agents, and the like.

The following non-limiting examples illustrate the present invention.

EXAMPLE I

| Ingredient | Percent (wt.) |
|---|---|
| $(CH_3)_2-N^+-[CH_2\underset{\underset{CH_3}{\vert}}{C}HOC(O)C_{15}H_{31}]_2Cl^-$ | 4.0% |
| Isopropanol | 0.5% |
| Polydimethysiloxane (PDMS) | 0.1% |
| Bronopol | 0.01% |
| 0.1 N HCl | 0.25% |
| Water | Balance |

24 g of the above biodegradable softener compound and 3 g of isopropanol are mixed and heated to 70° C. to form a fluidized "melt". The molten mixture is then poured into a 570 g water seat with high shear mixing. The water is preheated to 60° C., and 100 ppm Bronopol is added to the water prior to mixing. The dispersion is mixed for 15 minutes at 6500 rpm (Tekmar high shear mixer). During mixing the temperature of the dispersion is maintained at about 60° C. by a cooling water bath. After the dispersion is cooled down with an ice bath, to about 30° C., 0.4 g of PDMS (polydimethylsiloxane) is added to the dispersion with low shear mixing (3000 rpm for 3 minutes). The pH is adjusted by the addition of 1 ml of 0.1N HCl. The resulting dispersion has a viscosity of 76 centipoise (at 25° C.) and a pH of 3.8. The average particle size in the dispersion is 0.20 microns.

EXAMPLE II

| Ingredient | Percent (wt.) |
|---|---|
| $(CH_3)_2-N^+-[CH_2\underset{\underset{CH_3}{\vert}}{C}HOC(O)C_{15}H_{31}]_2Cl^-$ | 4.5% |
| Isopropanol | 0.6% |
| Glyceryl Monostearate (GMS) | 1.2% |
| Neodol 23-3 | 0.3% |
| Polydimethylsiloxane (PDMS) | 0.1% |
| 0.1 N HCl | 0.25% |
| Water | Balance |

18 g of the biodegradable softener compound and 2.4 g of isopropanol are mixed and heated to 75° C. to form a fluidized "melt". 4.8 g of GMS (glyceryl monostearate) and 1.2 g of Neodol 23-3 are then added to the melt to form a homogeneous molten mixture. The molten mixture is then poured into a 375 g water seat with high shear mixing. The water is preheated to 70° C. The dispersion is mixed for 15 minutes at 7000 rpm (Tekmar high shear mixer). After the dispersion cools down to about 30° C., 0.4 g of PDMS (polydimethylsiloxane) is added to the dispersion with low shear mixing (3000 rpm for 3 minutes). The pH is adjusted by the addition of 1 ml of 0.1N HCl. The resulting dispersion has a viscosity of 88 centipoise (at 25° C.) and a pH of 3.9. The average particle size in the dispersion is 0.19 microns.

EXAMPLE III

| Ingredient | Percent (wt.) |
|---|---|
| $(CH_3)_2-N^+-[CH_2\underset{\underset{CH_3}{\vert}}{C}HOC(O)C_{15}H_{31}]_2Cl^-$ | 4.5% |
| Isopropanol | 0.6% |
| Glyceryl Monostearate (GMS) | 1.2% |
| Protonated Monotallow-dipolyethoxyamine | 0.3% |
| Polydimethylsiloxane (PDMS) | 0.1% |
| Bronopol | 0.01% |
| 0.1 N HCl | 0.25% |
| Water | Balance |

18 g of the biodegradable softener compound and 2.4 g of isopropanol are mixed and heated to 75° C. to form a fluidized "melt". 4.8 g of GMS (glyceryl monostearate) and 1.2 g of (protonated monotallow-dipolyethyoxyamine) are then added to the melt to form a homogeneous molten mixture. The molten mixture is then poured into a 375 g water seat with high shear mixing. The water is preheated to 70° C. The dispersion is mixed for 15 minutes at 7000 rpm (Tekmar high shear mixer). After the dispersion cools down to about 30° C., 0.4 g of PDMS (polydimethylsiloxane) is added to the dispersion with low shear mixing (3000 rpm for 3 minutes). The pH is adjusted by the addition of 1 ml of 0.1N HCl. The resulting dispersion has a viscosity of 40 centipoise (at 25° C.) and a pH of 3.3. The average particle size is 0.17 microns.

EXAMPLE IV

| Ingredient | Percent (wt.) |
|---|---|
| $(CH_3)_2-N^+-[CH_2\underset{\underset{CH_3}{\vert}}{C}HOC(O)C_{15}H_{31}]_2Cl^-$ | 15% |
| Isopropanol | 2.5% |
| Neodol 91-2.5* | 0.5% |
| $CaCl_2$ | 0.06% |
| 0.1 N HCl | 0.25% |
| Water | Balance |

*The condensation product of $C_9$–$C_{11}$ linear alcohol with 2.5 moles ethylene oxide.

30 g of the biodegradable softener compound and 5 g of isopropanol are mixed and heated to 75° C. to form a fluidized melt. 1 g of Neodol 91-2.5 is then added to the melt to form a homogeneous molten mixture. The melt is then poured into a 165 g water seat with high shear mixing. The water is preheated to 60° C. The dispersion is mixed for 15 minutes at 7000 rpm (Tekmar high shear mixer). 6 ml of 2% $CaCl_2$ aqueous solution is added to the dispersion during mixing to prevent the dispersion from gelling. During mixing the dispersion's temperature is maintained at about 60° C. The pH is adjusted by the addition of 0.5 ml of 0.1N HCl. The resulting dispersion has a viscosity of 210 centipoise (at 25° C.) and a pH of 3.8. The average particle size in the dispersion is 0.26 microns.

In a convenient mode, this concentrated composition is packaged in a simple plastic pouch, which is opened and poured into 4× its volume of water prior to use to prepare a "single strength" softener composition, thereby saving on packaging and shipping costs, as well storage space.

EXAMPLE V

| Ingredient | Percent (wt.) |
|---|---|
| $(CH_3)_2-N^+-[CH_2\underset{\underset{CH_3}{\vert}}{C}HOC(O)C_{15}H_{31}]_2Cl^-$ | 10% |
| Isopropanol | 2.5% |
| $CaCl_2$ | 0.02% |
| 0.1 N HCl | 0.25% |
| Water | Balance |

20 g of the above biodegradable softener compound and 5 g of isopropanol are mixed and heated to 75° C. to form a molten mixture. The mixture is then poured into a 175 g water seat, with high shear mixing. The water is preheated to 60° C. 2 ml of 2% $CaCl_2$ aqueous solution is added to the dispersion during mixing to prevent the dispersion from gelling. During mixing (15 minutes, 7000 rpm) the dispersion's temperature is maintained at about 60° C. The pH is adjusted by the addition of 0.5 ml of 0.1N HCl. The resulting dispersion has a viscosity of 114 centipoise (at 25° C.) and a pH of 3.4. The average particle size in the dispersion is 0.25 microns.

In all of the above examples, substantially similar results are obtained when the biodegradable quaternary ammonium softening compound is replaced, in whole or in part, with any of the following biodegradable quaternary ammonium softening compounds:

$$[HO-CH(CH_3)CH_2][CH_3]^+N[CH_2CH(CH_3)OC(O)C_{15}H_{31}]_2Br^-$$

$$[C_2H_5]_2^+N[CH_2CH(CH_3)OC(O)C_{17}H_{35}]_2Cl^-$$

$$[CH_3][C_2H_5]^+N[CH_2CH(C_2H_5)OC(O)C_{13}H_{27}]_2I^-$$

$$[C_3H_7][C_2H_5]^+N[CH_2CH(C_3H_7)OC(O)C_{15}H_{31}]_2SO_4^-CH_3$$

$$[CH_3]_2^+\underset{\underset{CH_2CH(CH_3)OC(O)C_{17}H_{35}}{\vert}}{N}-CH_2CH(CH_3)OC(O)C_{15}H_{31}Cl^-$$

Similar results are also obtained when isopropanol in the above examples is replaced, in whole or in part, with ethanol, propanol, butanol, or mixtures thereof and when HCl is replaced, in whole or in part, with $H_3PO_4$.

In addition, the process steps disclosed herein for preparing biodegradable fabric softening compositions do not necessarily have to be carried out sequentially. For example, the diluting step and the high shear mixing step can be carried out either concurrently or sequentially. Similarly, one could adjust the pH by Bronsted acid addition at a point in the process other than the end, if desired. Thus, the present invention should not be construed as requiring the processing steps to be carried out in the order listed in the above examples.

It will, of course, be appreciated by those skilled in the art that the amine feedstocks used herein may contain varying, small amounts of mono-isopropanol and tri-isopropanol amines. Accordingly, the commercial-grade ester reaction products will comprise, in addition to the di-ester softeners, various amounts of mono- and tri-esters. Moreover, it may be more economical, on a commercial scale, to prepare the esters herein using acids and appropriate catalysts, rather than acid chlorides. Such matters are well within routine commercial know-how, and do not depart from the spirit and scope of the present invention. Importantly, the novel process disclosed herein provides a method for manufacturing biodegradable, shelf-stable fabric softening compositions containing quaternized di-esters of di-isopropanol amines.

What is claimed is:

1. A method for preparing aqueous biodegradable shelf-stable fabric softening compositions comprising the steps of:

(a) combining a $C_1$–$C_4$ monohydric alcohol with a biodegradable quaternary ammonium softening compound of the formula:

$$[R]_2-{}^+N-[CH_2\underset{\underset{R''}{\vert}}{C}H-O-C(O)R']_2X^-$$

wherein each R is a $C_1$–$C_6$ alkyl or hydroxyalkyl group, or mixtures thereof; each R′ is a $C_{13}$–$C_{19}$ hydrocarbyl group, or mixtures thereof; R″ is a $C_1$–$C_4$ hydrocarbyl group; and $X^-$ is a softener-compatible anion; to form a mixture wherein the amount of the $C_1$–$C_4$ monohydric alcohol comprises from about 5% to about 50% by weight of the biodegradable quaternary ammonium softening compound;

(b) heating said mixture to a temperature of from about 60° C. to about 90° C. to form a fluidized melt;

(c) diluting said melt with water, heated to a temperature of from about 50° C. to about 85° C., to a concentration of from about 1% to about 25% by weight of the biodegradable quaternary ammonium softening compound to form a dilute mixture;

(d) mixing said dilute mixture with a high shear mixer to form a homogeneous mixture with the softener compound having a particle size of from about 0.1 to about 0.5 microns; and (e) adjusting the pH of said homogenous mixture to from about 2.0 to about 5.0 by adding a sufficient amount of a Bronsted acid to the homogeneous mixture to thereby form said fabric softening compositions wherein said compositions are maintained substantially free of free amines.

2. A method according to claim 1 wherein the homogenous mixture formed in step (c) has a concentration of from about 3% to about 8% of the biodegradable quaternary ammonium softening compound.

3. A method according to claim 1 wherein the pH of the homogeneous mixture in step (e) is from about 3.0 to about 4.0.

4. A method according to claim 1 wherein each R is $C_1$ to $C_3$ alkyl, R′ is $C_{13}$–$C_{17}$ alkyl, and R″ is methyl.

5. A method according to claim 4 wherein each R group is methyl.

6. A method according to claim 1 wherein the $C_1$–$C_4$ monohydric alcohol is isopropanol.

7. A method according to claim 1 wherein the mixture in step (a) additionally contans no more than about 1.0% of a protonated free amine.

8. A method according to claim 7 wherein the free amine is protonated monotallow-dipolyethoxyamine.

9. A method according to claim 1 wherein the mixture in step (a) additionally contains from about 0.1% to about 10% of a conventional di-(higher alkyl) quaternary ammonium softening agent.

10. A method according to claim 1 wherein the mixture in step (a) additionally contains from about 0.1% to about 10% by weight of a nonionic extender.

11. A method according to claim 10 wherein the nonionic extender is selected from the group consisting of glycerol monostearate, ethoxylated linear alcohols, and mixtures thereof.

12. A method according to claim 1 wherein the mixture formed in step (d) additionally contains from about 0.1% to about 10.0% of a predominantly linear di($C_1$–$C_5$) alkyl or $C_1$–$C_5$ alkylaryl siloxane in which the alkyl groups may be partially or wholly fluorinated and which may be substituted with cationic nitrogen groups, the siloxane having a viscosity at 25° C. of from about 100 centistokes to about 100,000 centistokes.

13. A method according to claim 12 wherein the siloxane is a polydimethyl siloxane.

14. A method according to claim 1 wherein the mixture formed in step (c) has a concentration of from about 10% to about 25% of biodegradable quaternary ammonium softening compound.

15. A method according to claim 14 wherein the mixture in step (c) additionally contains from about 20 to about 3,000 ppm of a salt selected from the group consisting of calcium chloride, magnesium chloride, sodium chloride, potassium chloride, lithium chloride, and mixtures thereof.

16. A method according to claim 15 wherein the salt is calcium chloride.

17. A method according to claim 1 wherein the Bronsted acid in step (e) is selected from the group consisting of hydrochloric acid, phosphoric acid, formic acid, methylsulfonic acid, benzoic acid, and mixtures thereof.

18. A method according to claim 17 wherein the Bronsted acid is selected from the group consisting of phosphoric acid, hydrochloric acid, and mixtures thereof.

19. A method according to claim 1 wherein the mixture in step (b) is heated to a temperature of from about 70° C. to about 80° C.

20. A method according to claim 1 wherein the water in step (c) is heated to a temperature of from about 60° C. to about 80° C.

21. The product made by the process of claim 1.

22. The product made by the process of claim 4.

23. The product made by the process of claim 5.

24. The product made by the process of claim 6.

25. The product made by the process of claim 14.

26. The product made by the process of claim 18.

* * * * *